US009953819B2

(12) United States Patent
Bajic

(10) Patent No.: US 9,953,819 B2
(45) Date of Patent: Apr. 24, 2018

(54) IMPACTOR SPRAY ATMOSPHERIC PRESSURE ION SOURCE WITH TARGET PADDLE

(71) Applicant: Micromass UK Limited, Wilmslow (GB)

(72) Inventor: Stevan Bajic, Sale (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/121,508

(22) PCT Filed: Feb. 26, 2015

(86) PCT No.: PCT/GB2015/050556

§ 371 (c)(1),
(2) Date: Aug. 25, 2016

(87) PCT Pub. No.: WO2015/128652

PCT Pub. Date: Sep. 3, 2015

(65) Prior Publication Data

US 2016/0365232 A1 Dec. 15, 2016

(30) Foreign Application Priority Data

Feb. 26, 2014 (EP) ..... 14156845
Feb. 26, 2014 (GB) ..... 1403370.8

(51) Int. Cl.

| | |
|---|---|
| ***H01J 49/04*** | (2006.01) |
| ***H01J 49/14*** | (2006.01) |
| ***H01J 49/00*** | (2006.01) |
| ***H01J 49/16*** | (2006.01) |

(52) U.S. Cl.
CPC ..... *H01J 49/045* (2013.01); *H01J 49/0031* (2013.01); *H01J 49/0445* (2013.01); *H01J 49/142* (2013.01); *H01J 49/16* (2013.01)

(58) Field of Classification Search
CPC .... H01J 49/045; H01J 49/0031; H01J 49/142; H01J 49/0445; H01J 49/16
USPC ..... 250/281, 282, 288
See application file for complete search history.

(56) References Cited

U.S. PATENT DOCUMENTS

| | | | |
|---|---|---|---|
| 5,986,259 | A | 10/1999 | Hirabayashi et al. |
| 7,465,940 | B2 | 12/2008 | Franzen |
| 7,772,548 | B2 | 8/2010 | Wollnik |
| 8,232,520 | B2 | 7/2012 | Cristoni |
| 8,314,382 | B2 | 11/2012 | Takats |

(Continued)

FOREIGN PATENT DOCUMENTS

JP 2002190272 7/2002

*Primary Examiner* — Nicole Ippolito
(74) *Attorney, Agent, or Firm* — Womble Bond Dickinson (US) LLP; Deborah M. Vernon; Heath T. Misley

(57) ABSTRACT

An ion source is provided comprising one or more nebulizers and one or more targets, wherein the one or more nebulizers are arranged and adapted to emit, in use, a stream predominantly of droplets which are caused to impact upon the one or more targets and to ionise the droplets to form a plurality of ions. The ion source further comprises one or more electrodes arranged adjacent to and/or attached to the one or more targets wherein the one or more electrodes comprise one or more apertures, notches or cut-outs wherein at least some of the plurality of ions pass, in use, through the one or more apertures, notches or cut-outs.

22 Claims, 3 Drawing Sheets

(56) References Cited

U.S. PATENT DOCUMENTS

| | | | | |
|---|---|---|---|---|
| 9,082,603 | B2 | 7/2015 | Bajic | |
| 9,117,642 | B2 * | 8/2015 | Bajic | H01J 49/0454 |
| 9,287,100 | B2 | 3/2016 | Szalay et al. | |
| 9,484,195 | B2 | 11/2016 | Ouyang et al. | |
| 9,618,488 | B2 * | 4/2017 | Bajic | G01N 30/7266 |
| 2003/0119193 | A1 | 6/2003 | Hess et al. | |
| 2010/0096541 | A1 * | 4/2010 | Okumura | H01J 49/065<br>250/281 |

* cited by examiner

IMPACTOR SPRAY ATMOSPHERIC PRESSURE ION SOURCE WITH TARGET PADDLE

CROSS-REFERENCE TO RELATED APPLICATIONS

This application is the National Stage of International Application No. PCT/GB2015/050566, filed 26 Feb. 2015 which claims priority from and the benefit of United Kingdom patent application No. 1403370.8 filed on 26 Feb. 2014 and European patent application No. 14156845.1 filed on 26 Feb. 2014. The entire contents of these applications are incorporated herein by reference.

BACKGROUND TO THE PRESENT INVENTION

The present invention relates to an ion source, a mass spectrometer, a method of ionising ions and a method of mass spectrometry.

Impactor spray atmospheric pressure ionisation ("API") ion sources are known and comprise an arrangement wherein a heated, high velocity liquid spray is emitted from a nebuliser and is directed so as to impact upon a small cylindrical rod target that is held at a relatively high potential with respect to the nebuliser. The resulting plume from the target is then sampled into the first vacuum stage of a mass spectrometer for subsequent mass analysis.

Conventional atmospheric pressure ionisation ion sources typically use a curtain or cone gas that creates a gas flow between the ion inlet and the ionisation probe that is countercurrent to the direction of the ions and charged particles emanating from the probe.

The curtain or cone gas reduces the effects of ion inlet contamination and this is particularly useful for low cost instruments that utilise relatively small inlet orifices (≤0.2 mm). Additionally, the curtain or cone gas can reduce the level of background chemical noise by preventing neutral contaminants (reactants or adducting agents) from entering the mass spectrometer.

A problem with the known arrangement is that if the cone gas flow is maintained at a flow rate which exceeds the flow of gas being drawn through the inlet into the first vacuum stage of the mass spectrometer then ion signal losses can become significant.

Accordingly, known impactor spray ion sources suffer from a loss of ion signal at high cone gas flow rates which is particularly problematic.

WO2012/143737 (Micromass) discloses an impactor spray atmospheric pressure ionisation ("API") ion source.

WO2013/098642 (Szalay) discloses a collision ion generator and separator.

WO2010/045049 (Ouyang) discloses systems and methods for transfer of ions for analysis.

WO2007/138371 (Takats) discloses an arrangement for desorption ionisation by liquid jet.

EP1855306 (Cristone) discloses an ionisation source and method for mass spectrometry.

U.S. Pat. No. 5,986,259 (Hirabayashi) discloses a mass spectrometer.

US2006/0108539 (Franzen) discloses an arrangement of ionisation by droplet impact.

US2009/0278036 (Wollnik) discloses a droplet pickup ion source coupled to mobility analyser apparatus and method.

JP2002/190272 (Susumu) discloses an electron-spray ion source.

US2003/0119193 (Hess) discloses a system and method for high throughput screening of droplets.

It is desired to provide an improved ion source and an improved method of ionising ions.

SUMMARY OF THE PRESENT INVENTION

According to an aspect of the present invention there is provided an ion source comprising:

one or more nebulisers and one or more targets, wherein the one or more nebulisers are arranged and adapted to emit, in use, a stream predominantly of droplets which are caused to impact upon the one or more targets and to ionise the droplets to form a plurality of ions; and wherein the ion source further comprises:

one or more electrodes arranged adjacent to and/or attached to the one or more targets wherein the one or more electrodes comprise one or more apertures, notches or cut-outs wherein at least some of the plurality of ions pass, in use, through the one or more apertures, notches or cut-outs.

It will be appreciated that the present invention relates to an impactor spray atmospheric pressure ionisation ("API") ion source, and not an electrospray ion source as disclosed in JP2002/190272 (Susumu) and US2009/0278036 (Wollnik).

In a similar manner, the present invention is also distinct from the methods described in U.S. Pat. No. 5,986,259 (Hirabayashi), in which ions are formed by nebulising a sample solution with a gas at a sonic velocity. In contrast, the present invention involves ionising a stream of droplets using the impact of the stream of droplets on a target.

The present invention is also distinct from the method described in US2003/0119193 (Hess), in which ions are formed by an electrospray method and then desolvated using a target, as shown in FIGS. 14-16 and described at paragraph 160. In contrast, the present invention preferably involves ionising a stream of droplets using the impact of the stream of droplets on a target. The stream predominantly of droplets may be caused to impact upon the one or more targets so as to ionise the droplets to form a plurality of ions.

The present invention is particularly advantageous in that one or more electrodes are arranged adjacent to and/or attached to the one or more targets wherein the one or more electrodes comprise one or more apertures, notches or cut-outs wherein at least some of the plurality of ions pass, in use, through the one or more apertures, notches or cut-outs. This is in contrast to the approaches described in US2006/0108539 (Franzen), WO2012/143737 (Micromass), US2003/0119193 (Hess), EP1855306 (Cristone) and WO2007/138371 (Takats), for example, which do not disclose an electrode that is adjacent, or attached to one or more targets.

The term "adjacent" should be interpreted herein to mean "next to", or preferably "immediately adjacent", such that, for example, the one or more apertures, notches or cut-outs are positioned in a flow of gas across or around the target, for example a Coanda flow of gas around the target. The one or more electrodes may be located at a separation point of the flow of gas across or around the target.

The target is preferably a rod target, a cylindrical target or comprises a curved surface. The stream predominantly of droplets are preferably caused to impact upon the curved surface, or the curved surface of the rod or cylindrical target. The plurality of ions preferably formed by the impact of the droplets on the curved surface are then preferably entrained in the flow of gas around the curved surface, known as the Coanda flow of gas. The target and/or curved surface may be arranged such that the flow of gas, which carries the plurality of ions, is subsequently directed to the inlet of a or the mass spectrometer.

The one or more targets may be arranged less than 50 mm, 20 mm, 10 mm or 5 mm from the nebuliser.

The one or more electrodes may be distinct from the inlet electrode of a mass spectrometer. The one or more electrodes may be distinct from the one or more targets. The stream predominantly of droplets is aimed at or caused to impact upon the one or more targets, and preferably not aimed at or caused to impact upon the one or more electrodes. The one or more electrodes may be placed in a region of atmospheric pressure. The one or more apertures, notches or cut-outs may, or may be arranged and adapted to lead into a region of atmospheric pressure.

The one or more electrodes may comprise one or more flat-plate and/or paddle and/or grid electrodes containing one or more exit apertures, notches or cut-outs. The one or more electrodes which may be attached to the rod or other target preferably improves ion signal intensity under conditions of strong curtain gas flow. The one or more electrodes can also be used to simplify and improve the interfacing of an impactor spray ion source with an ion inlet device of a mass spectrometer that preferably requires a uniform rather than a non-uniform electric field.

The preferred embodiment may increase or shape the electric field between the target and the inlet to a or the mass spectrometer. This preferably increases the ion drift field in this region. The preferred embodiment preferably results in a less dispersive gas flow into the inlet to a or the mass spectrometer. The inlet may be the first vacuum inlet of a or the mass spectrometer. The preferred embodiment improves the source performance of an impactor ion source under conditions of high cone gas flow.

The preferred embodiment also assists in reducing source contamination and chemical background.

A yet further advantage of the preferred embodiment is that the preferred ion source may be used to interface an impactor spray ion source to an ion inlet device of a mass spectrometer wherein an ion mobility drift tube or ion mobility device forms at least a portion of the interface.

The one or more targets may be shaped or may have an aerodynamic profile so that gas flowing past the one or more targets is directed or deflected towards and/or through the one or more apertures, notches or cut-outs.

The one or more targets may be arranged or otherwise positioned so as to deflect the stream of droplets and/or the plurality of ions towards and/or through the one or more apertures, notches or cut-outs.

The one or more apertures, notches or cut-outs may be located at or otherwise arranged in the vicinity of or immediately downstream of the impact point of the droplet stream upon the one or more targets.

The one or more electrodes are preferably attached to and/or contact the one or more targets. The one or more electrodes may be located immediately adjacent the one or more targets and/or impact point of the stream predominantly of droplets thereon, for example within 0.1 mm, 0.2 mm, 0.5 mm, 1 mm, 2 mm or 5 mm of the one or more targets and/or impact point of the stream predominantly of droplets thereon.

The one or more electrodes are preferably positioned in a plane which is substantially perpendicular to a primary or predominant direction of gas flow through the one or more apertures, notches or cut-outs.

The one or more electrodes preferably have substantially smooth or deburred edges.

The ion source preferably comprises an Atmospheric Pressure Ionisation ("API") ion source.

The one or more nebulisers may be arranged and adapted to nebulise one or more eluents emitted by one or more liquid chromatography separation devices over a period of time. The one or more eluents may have a liquid flow rate selected from the group consisting of: (i) <1 μL/min; (ii) 1-10 μL/min; (iii) 10-50 μL/min; (iv) 50-100 μL/min; (v) 100-200 μL/min; (vi) 200-300 μL/min; (vii) 300-400 μL/min; (viii) 400-500 μL/min; (ix) 500-600 μL/min; (x) 600-700 μL/min; (xi) 700-800 μL/min; (xii) 800-900 μL/min; (xiii) 900-1000 μL/min; (xiv) 1000-1500 μL/min; (xv) 1500-2000 μL/min; (xvi) 2000-2500 μL/min; and (xvii) >2500 μL/min.

The one or more nebulisers may each comprise a first capillary tube and having an exit which emits said stream of droplets, which may be a stream of analyte droplets. The target may be positioned <10 mm from the exit of the nebuliser. The spray point of the stream of droplets may be located at the tip of the inner capillary tube and the distance between the spray point and the target may be <10 mm. The nebuliser preferably does not emit a vapour stream. The nebuliser emits a stream predominantly of droplets, preferably a high density droplet stream. Furthermore, the impact velocity of the droplet stream upon the target may be relatively high and may be greater than 10 m/s, 20 m/s, 50 m/s or 100 m/s.

According to another aspect of the present invention there is provided a mass spectrometer comprising an ion source as described above.

The mass spectrometer preferably further comprises an ion inlet device which leads to a first vacuum stage of the mass spectrometer.

According to an embodiment in a mode of operation the ion inlet device and/or the one or more targets and/or the one or more electrodes are maintained at different potentials.

According to an embodiment in a mode of operation the ion inlet device and/or the one or more targets and/or the one or more electrodes are maintained at different potentials such that an electric field is created therebetween that substantially assists or opposes the flow of ions.

The mass spectrometer preferably further comprises an insulating tube or housing which is attached to or arranged adjacent to the ion inlet device and wherein the one or more electrodes are attached to or arranged adjacent to the insulating tube or housing.

The mass spectrometer preferably further comprises an ion mobility spectrometer or separator attached to or arranged adjacent to the ion inlet device and/or arranged within the insulating tube or housing.

The ion mobility spectrometer or separator preferably comprises a plurality of further electrodes having apertures through which ions are transmitted in use.

The one or more electrodes are preferably attached to or arranged adjacent to the ion mobility spectrometer or separator.

The ion mobility spectrometer or separator preferably further comprises one or more ion gating or ion injection devices.

The one or more ion gating or ion injection devices are preferably arranged and adapted to pulse ions into an ion mobility drift region arranged between the one more ion gating or injection devices and the ion inlet device, whereupon the ions are separated temporally according to their ion mobility as the ions are urged towards the ion inlet device.

According to another aspect of the invention there is provided an ion mobility spectrometer or separator comprising an ion source as described above.

According to another aspect of the present invention there is provided a method of ionising a sample comprising:

providing one or more nebulisers and one or more targets;

causing the one or more nebulisers to emit a stream predominantly of droplets which are caused to impact upon the one or more targets and to ionise the droplets to form a plurality of ions;

positioning one or more electrodes adjacent to and/or attached to the one or more targets wherein the one or more electrodes comprise one or more apertures, notches or cut-outs; and causing at least some of the plurality of ions to pass through the one or more apertures, notches or cut-outs.

According to another aspect of the present invention there is provided a method of mass spectrometry comprising a method of ionising a sample as described above.

The one or more nebulisers may be arranged and adapted such that the majority of the mass or matter emitted by the one or more nebulisers is in the form of droplets not vapour and wherein preferably at least 50%, 55%, 60%, 65%, 70%, 75%, 80%, 85%, 90% or 95% of the mass or matter emitted by the one or more nebulisers is in the form of droplets.

In a mode of operation an ion inlet device which leads to a first vacuum stage of a mass spectrometer and/or the one or more targets and/or the one or more electrodes are preferably maintained at different potentials, such that an electric field is created therebetween that substantially assists or opposes the flow of ions.

The one or more nebulisers preferably comprises a first capillary tube having an exit which emits, in use, the stream of droplets, wherein preferably the first capillary tube is maintained, in use, at a potential: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV.

The first capillary tube is preferably arranged and adapter to emit said stream of droplets at a flow rate of: (i) <10 nL/min; (ii) 10-20 nL/min; (iii) 20-30 nL/min; (iv) 30-40 nL/min; (v) 40-50 nL/min; (vi) 50-100 nL/min; (vii) 100-200 nL/min; (viii) 200-300 nL/min; (ix) 300-400 nL/min; (x) 400-500 nL/min; (xi) 500-600 nL/min; (xii) 600-700 nL/min; (xiii) 700-800 nL/min; (xiv) 800-900 nL/min; (xv) 900-1000 nL/min; (xvi) 1-1.5 mL/min; (xvii) 1.5-2 mL/min; (xviii) 2-2.5 mL/min; (xix) 2.5-3 mL/min; (xx) 3-3.5 mL/min; (xxi) 3.5-4 mL/min; (xxii) 4-4.5 mL/min; (xxiii) 4.5-5 mL/min; (xxiv) 5-5.5 mL/min; (xxv) 5.5-6 mL/min; (xxvi) 6-6.5 mL/min; (xxvii) 6.5-7 mL/min; (xxviii) 7-7.5 mL/min; (xxix) 7.5-8 mL/min; (xxx) 8-8.5 mL/min; (xxxi) 8.5-9 mL/min; (xxxii) 9-9.5 mL/min; (xxxiii) 9.5-10 mL/min.

The first capillary tube may be maintained, in use, at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV relative to the potential of an enclosure surrounding the ion source and/or an ion inlet device which leads to a first vacuum stage of a mass spectrometer and/or the one or more electrodes and/or the one or more targets.

The exit of the first capillary tube may have a diameter D and the spray of droplets may be arranged to impact on an impact zone of the one or more targets, wherein the impact zone preferably has a maximum dimension of x and wherein the ratio x/D is preferably in the range <2, 2-5, 5-10, 10-15, 15-20, 20-25, 25-30, 30-35, 35-40 or >40.

The impact zone preferably has an area selected from the group consisting of: (i) <0.01 $mm^2$; (ii) 0.01-0.10 $mm^2$; (iii) 0.10-0.20 $mm^2$; (iv) 0.20-0.30 $mm^2$; (v) 0.30-0.40 $mm^2$; (vi) 0.40-0.50 $mm^2$; (vii) 0.50-0.60 $mm^2$; (viii) 0.60-0.70 $mm^2$; (ix) 0.70-0.80 $mm^2$; (x) 0.80-0.90 $mm^2$; (xi) 0.90-1.00 $mm^2$; (xii) 1.00-1.10 $mm^2$; (xiii) 1.10-1.20 $mm^2$; (xiv) 1.20-1.30 $mm^2$; (xv) 1.30-1.40 $mm^2$; (xvi) 1.40-1.50 $mm^2$; (xvii) 1.50-1.60 $mm^2$; (xviii) 1.60-1.70 $mm^2$; (xix) 1.70-1.80 $mm^2$; (xx) 1.80-1.90 $mm^2$; (xxi) 1.90-2.00 $mm^2$; (xxii) 2.00-2.10 $mm^2$; (xxiii) 2.10-2.20 $mm^2$; (xxiv) 2.20-2.30 $mm^2$; (xxv) 2.30-2.40 $mm^2$; (xxvi) 2.40-2.50 $mm^2$; (xxvii) 2.50-2.60 $mm^2$; (xxviii) 2.60-2.70 $mm^2$; (xxix) 2.70-2.80 $mm^2$; (xxx) 2.80-2.90 $mm^2$; (xxxi) 2.90-3.00 $mm^2$; (xxxii) 3.00-3.10 $mm^2$; (xxxiii) 3.10-3.20 $mm^2$; (xxxiv) 3.20-3.30 $mm^2$; (xxxv) 3.30-3.40 $mm^2$; (xxxvi) 3.40-3.50 $mm^2$; (xxxvii) 3.50-3.60 $mm^2$; (xxxviii) 3.60-3.70 $mm^2$; (xxxix) 3.70-3.80 $mm^2$; (xl) 3.80-3.90 $mm^2$; and (xli) 3.90-4.00 $mm^2$.

The one or more apertures, notches or cut-outs preferably have an area selected from the group consisting of: (i) <0.01 $mm^2$; (ii) 0.01-0.10 $mm^2$; (iii) 0.10-0.20 $mm^2$; (iv) 0.20-0.40 $mm^2$; (v) 0.40-0.60 $mm^2$; (vi) 0.60-0.80 $mm^2$; (vii) 0.80-1.00 $mm^2$; (viii) 1.00-1.20 $mm^2$; (ix) 1.20-1.40 $mm^2$; (x) 1.40-1.60 $mm^2$; (xi) 1.60-1.80 $mm^2$; (xii) 1.80-2.00 $mm^2$; (xiii) 2.00-2.20 $mm^2$; (xiv) 2.20-2.40 $mm^2$; (xv) 2.40-2.60 $mm^2$; (xvi) 2.60-2.80 $mm^2$; (xvii) 2.80-3.00 $mm^2$; (xviii) 3.00-3.20 $mm^2$; (xix) 3.20-3.40 $mm^2$; (xx) 3.40-3.60 $mm^2$; (xxi) 3.60-3.80 $mm^2$; (xxii) 3.80-4.00 $mm^2$; (xxiii) 4.00-4.20 $mm^2$; (xxiv) 4.20-4.40 $mm^2$; (xxv) 4.40-4.60 $mm^2$; (xxvi) 4.60-4.80 $mm^2$; (xxvii) 4.80-5.00 $mm^2$; (xxviii) 5.00-5.50 $mm^2$; (xxix) 5.50-6.00 $mm^2$; (xxx) 6.00-6.50 $mm^2$; (xxxi) 6.50-7.00 $mm^2$; (xxxii) 7.00-7.50 $mm^2$; (xxxiii) 7.50-8.00 $mm^2$; (xxxiv) 8.00-8.50 $mm^2$; (xxxv) 8.50-9.00 $mm^2$; (xxxvi) 9.00-9.50 $mm^2$; (xxxvii) 9.50-10.00 $mm^2$.

The one or more targets are preferably maintained, in use, at a potential: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV.

The one or more targets may be maintained, in use, at a potential (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV relative to the potential of an enclosure surrounding the ion source and/or an ion inlet device which leads to a first vacuum stage of a mass spectrometer and/or the one or more electrodes and/or the one or more nebulisers.

The one or more electrodes are preferably maintained, in use, at a potential: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV.

The one or more electrodes are preferably maintained, in use, at a potential (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV relative to the potential of an enclosure surrounding the ion source and/or an ion inlet device which leads to a first vacuum stage of a mass spectrometer and/or the one or more targets and/or the one or more nebulisers.

The one or more targets may comprise a stainless steel target, a metal, gold, a non-metallic substance, a semiconductor, a metal or other substance with a carbide coating, an insulator or a ceramic.

The one or more targets are preferably positioned upstream of an ion inlet device of a mass spectrometer so that ions are deflected towards the direction of the ion inlet device.

The one or more targets are preferably shaped or have an aerodynamic profile so that gas flowing past the one or more targets is directed or deflected towards, parallel to, orthogonal to or away from an ion inlet device of a mass spectrometer.

At least some or a majority of the plurality of ions are preferably arranged so as to become entrained, in use, in the gas flowing past the one or more targets.

The ion inlet device may comprise an ion orifice, an ion inlet cone, an ion inlet capillary, an ion inlet heated capillary, an ion tunnel or other ion inlet.

The one or more targets are preferably located at a first distance $x_1$ in a first direction from the ion inlet device and at a second distance $y_1$ in a second direction from the ion inlet device, wherein the second direction is orthogonal to the first direction and wherein:

(i) $x_1$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (ii) $y_1$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The one or more electrodes may form part of an insulating tube of the ion inlet device.

The ion inlet device may comprise or include an ion mobility spectrometer or separator, a differential ion mobility spectrometer, a Field Asymmetric Ion Mobility Spectrometer ("FAIMS") device. The ion mobility spectrometer or separator, differential ion mobility spectrometer, or Field Asymmetric Ion Mobility Spectrometer ("FAIMS") device preferably comprises a plurality of electrodes having apertures through which ions travel in use.

The one or more targets may be positioned so as to deflect the stream of droplets and/or the plurality of ions towards the ion inlet device. The one or more targets are preferably positioned upstream of the ion inlet device.

The mass spectrometer may further comprise an enclosure enclosing the one or more nebulisers and/or the one or more targets and/or the ion inlet device of a mass spectrometer.

The mass spectrometer may further comprise one or more deflection or pusher electrodes, wherein in use one or more DC voltages or DC voltage pulses are preferably applied to the one or more deflection or pusher electrodes in order to deflect or urge ions towards an ion inlet device of the mass spectrometer.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source.

According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

The preferred embodiment is preferably aimed at increasing the electric field between the target and the first vacuum inlet to the mass spectrometer, such that the ion drift field in this region is preferably increased.

The inlet to the mass spectrometer may have a cone gas which preferably aids in desolvating ions produced by the ion source. High cone gas flows may be used to kill background ions so as to preferably increase the signal to noise ratio of the ion signal to aid detection of analyte ions. The cone gas may, in particular at high cone gas flow, act against the gas flow containing the plurality of ions produced by the impactor spray source. This can be detrimental to the source performance of the ion source.

The preferred embodiment provides one or more electrodes adjacent or attached to the target in order to preferably increase or shape the electric field between the target and the inlet to the mass spectrometer. It has further been found that field shaping using a rod, cylindrical or other target having a curved impact surface can be particularly difficult, and the electrode of the preferred embodiment is particularly advantageous when used adjacent or attached to a rod, cylindrical or other target having a curved impact surface.

Using a curved impact surface as in the preferred embodiment may be optimal for ion production using an impact source as described herein, but such a surface may not be optimal for shaping the electric field between the target and the inlet to the mass spectrometer. Thus, an aim of the preferred embodiment is to increase or shape the electric field between the target and the inlet to the mass spectrometer using the electrode comprising one or more apertures, notches or cut-outs wherein at least some of said plurality of ions pass, in use, through said one or more apertures, notches or cut-outs as described herein.

According to a preferred embodiment a liquid stream is preferably converted into a nebulised spray via a concentric flow of high velocity gas without the aid of a high potential difference at the sprayer or nebuliser tip. A micro target with comparable dimensions or impact zone to the droplet stream is preferably positioned in close proximity (e.g. <10 mm or <5 mm) to the sprayer tip to define an impact zone and to partially deflect the spray towards the ion inlet orifice of the mass spectrometer.

The impact zone is preferably a curved surface that causes analyte molecules in said spray to ionise whilst preferably causing a Coanda flow of gas to form around the curved surface. The flow of gas preferably follows the curvature of the curved surface, for example in a boundary layer, until a point at which the flow separates from the surface and is preferably directed to the inlet of a mass spectrometer. The one or more electrodes may be located at the separation point of the flow of gas. The resulting ions and charged droplets are sampled by the first vacuum stage of the mass spectrometer.

According to the preferred embodiment the target preferably comprises a stainless steel target. However, other embodiments are contemplated wherein the target may comprise other metallic substances (e.g. gold) and non-metallic substances. Embodiments are contemplated, for example, wherein the target comprises a semiconductor, a metal or other substance with a carbide coating, an insulator or a ceramic.

BRIEF DESCRIPTION OF THE DRAWINGS

Various embodiments of the present invention will now be described, together with an arrangement given for illustrative purposes only, by way of example only, and with reference to the accompanying drawings in which.

DETAILED DESCRIPTION OF PREFERRED EMBODIMENT

A known impactor ion source will first be described with reference to FIG. 1.

Figure 1:
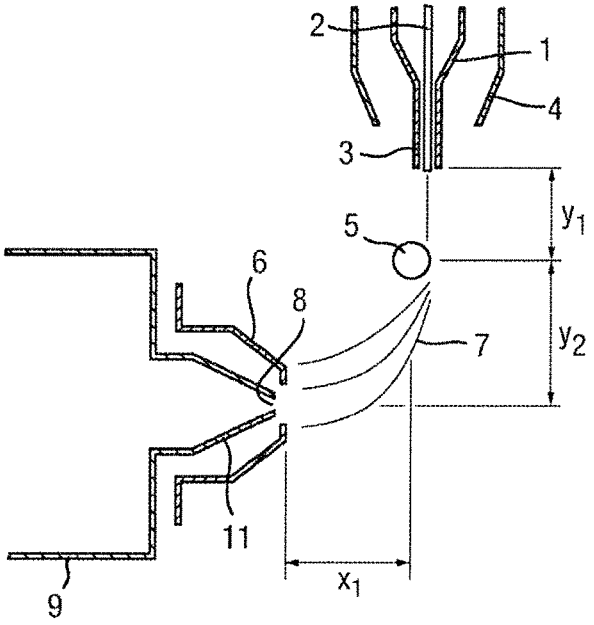
Fig. 1 Prior Art
FIG. 1 shows a known impactor spray ion source.

FIG. 1 shows a known impactor spray source comprising a pneumatic nebuliser assembly 1, a desolvation heater 4 which surrounds the nebuliser 1 and an impactor target 5 arranged downstream of the nebuliser 1. An inlet to a mass spectrometer is also shown. The inlet preferably comprises an ion inlet device comprising a cone gas nozzle 6 and an ion inlet orifice 8 formed within an ion inlet cone 11.

A first vacuum region 9 of the mass spectrometer is shown downstream of the ion inlet cone 11. The arrangement may be surrounded by an electrically grounded source enclosure (not shown) that contains an exhaust outlet for the venting of solvent fumes.

The nebuliser assembly 1 comprises an inner liquid capillary 2 and an outer gas capillary 3 that delivers a high velocity stream of gas at the nebuliser tip to aid the atomization of the liquid solvent flow.

The inner liquid capillary 2 typically has an internal diameter of 130 μm and an external diameter of 270 μm whilst the outer gas capillary has an internal diameter of 330 μm. The gas supply comprises nitrogen and is pressurised to 7 bar and the ion source may be operated at liquid flow rates of 0.01-2 mL/min.

A heated desolvation gas (e.g. nitrogen) flows between the nebuliser 1 and the heater 4 at a flow rate of typically 1200 L/hr.

A high velocity stream of droplets emerges from the nebuliser 1 and is arranged to impact upon a 1.6 mm diameter stainless steel cylindrical rod target 5. The distance $x_1$ between the ion inlet device and the centre of the target 5 is typically 5 mm. The distance $y_1$ between the exit of the nebuliser 1 and the centre of the target 5 is typically 3 mm. The distance $y_2$ between the centre of the target 5 and the longitudinal axis of the ion inlet is typically 7 mm.

The nebuliser 1 and the impactor target 5 are typically held at 0V and 1 kV respectively whilst the mass spectrometer inlet is typically maintained at a potential close to ground potential (e.g. 0-100 V). A nitrogen curtain or cone gas flow of typically 150 L/hr passes between the ion inlet cone 11 and the cone gas nozzle 6.

Ions, charged particles or neutrals that are contained within the gas flow wake 7 from the impactor target 5 enter the mass spectrometer via the ion inlet orifice 8 which forms a boundary between the first vacuum region 9 of the mass spectrometer and the atmospheric pressure region of the source enclosure (not shown).

When the diameter of the impactor target 5 is significantly greater than the internal diameter of the liquid capillary 2 it is advantageous to direct the spray such that the spray impacts the target 5 tangentially, for example, on the upper right hand quadrant in a manner substantially as shown in FIG. 1. Under these conditions the gas flow wake 7 follows the curvature of the target 5 due to the Coanda effect and the gas flow wake 7 is swung in the direction of the ion inlet orifice 8 which results in a greater ion signal intensity.

In both electrospray ("ESI") and impactor spray sources the degree of signal loss with increasing countercurrent cone gas flow can be reduced by increasing the electrospray probe or target voltage respectively. This would suggest that the electric field in the vicinity of the inlet region is important. However, in both cases the electric field lines emanating from geometrically point sources (in two dimensions) will be dispersive.

This effect will be further exacerbated in small volume atmospheric pressure ionisation ("API") ion sources having grounded components in close proximity.

A preferred embodiment of the present invention will now be described. The preferred embodiment relates to a modified impactor spray ion source which advantageously significantly preserves ion signal under conditions of relatively high cone gas flows.

Figure 2A:
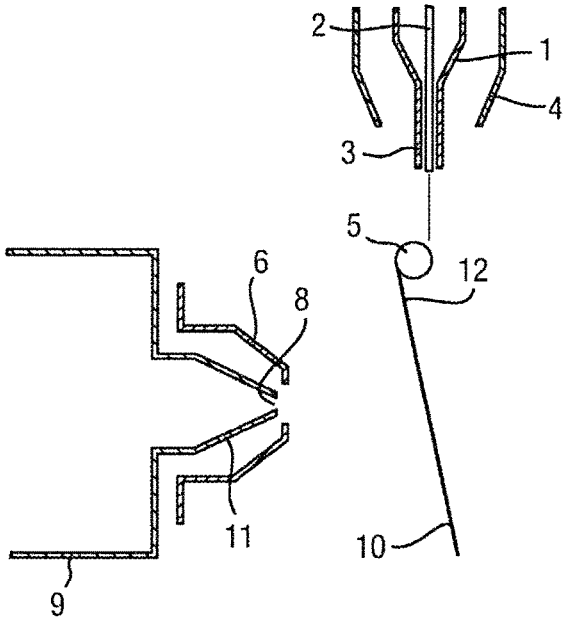
FIG. 2A shows a mass spectrometer according to a preferred embodiment of the present invention wherein an impactor spray ion source is provided comprising an additional electrode which is attached to the target of the impactor spray ion source and wherein an aperture is provided in the electrode and FIG. 2B shows a view facing the plane of the additional electrode.
Figure 2B:
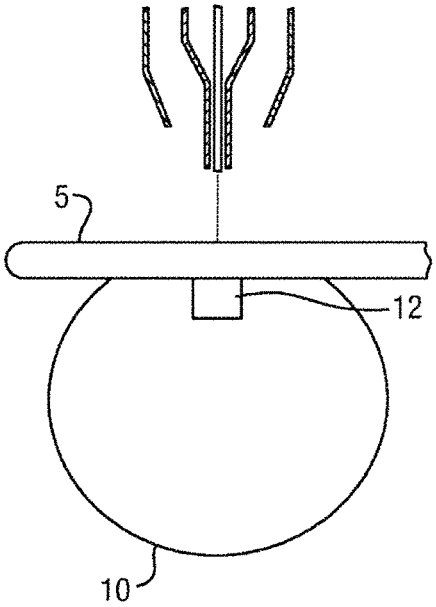

A preferred embodiment of the present invention will now be described with reference to FIG. 2A. FIG. 2A shows a side view of an impactor ion source according to a preferred embodiment of the present invention. The ion source according to the preferred embodiment preferably additionally comprises a 0.3 mm thick stainless steel paddle electrode 10 or plate. The additional paddle electrode 10 or plate preferably has an area which is preferably greater than the cross-sectional area of the cone gas nozzle 6 or other ion inlet device. FIG. 2B shows a front view of the preferred embodiment looking towards the cone gas nozzle 6 or other ion inlet device.

According to an embodiment the paddle electrode 10 or plate may be located close to the ion inlet device by connecting the paddle electrode 10 or plate to one side of the impactor target 5.

One or more preferably relatively small exit aperture(s) 12 are preferably cut into the paddle electrode 10 or plate preferably in the vicinity of the spray impact point so that the Coanda gas flow lines 7 (as shown in FIG. 1) pass substantially unhindered through the one or more apertures in the paddle electrode 10 or plate.

According to the preferred embodiment the exit aperture 12 is preferably substantially rectangular or square and according to an embodiment has dimensions of 3 mm×3 mm. However, according to other embodiments the one or more apertures, notches or cut-outs 12 which are preferably provided in the paddle electrode 10 or plate may have other dimensions or shapes. The one or more apertures, notches or cut-outs 12 may be located in one or more different positions on the paddle electrode 10 or plate to the position as shown and described above with reference to FIG. 2B.

The paddle electrode 10 or plate is preferably angled at an angle of approximately 14° anticlockwise from the pivot point so that the paddle electrode 10 or plate is preferably nominally perpendicular to the gas flow lines 7 immediately upstream of the inlet orifice (FIG. 1).

The geometrical shape of the paddle electrode 10 or plate may take various different forms. The edges of the paddle electrode 10 or plate are preferably deburred or smoothed since the paddle electrode 10 or plate may be maintained at a relatively high voltage.

According to another embodiment the paddle electrode 10 or plate may alternatively be attached to the opposite side of the target 5 from the position shown in FIG. 2A and the one or more apertures 12 may be positioned so as not to interfere with the spray impact point.

Figure 3:
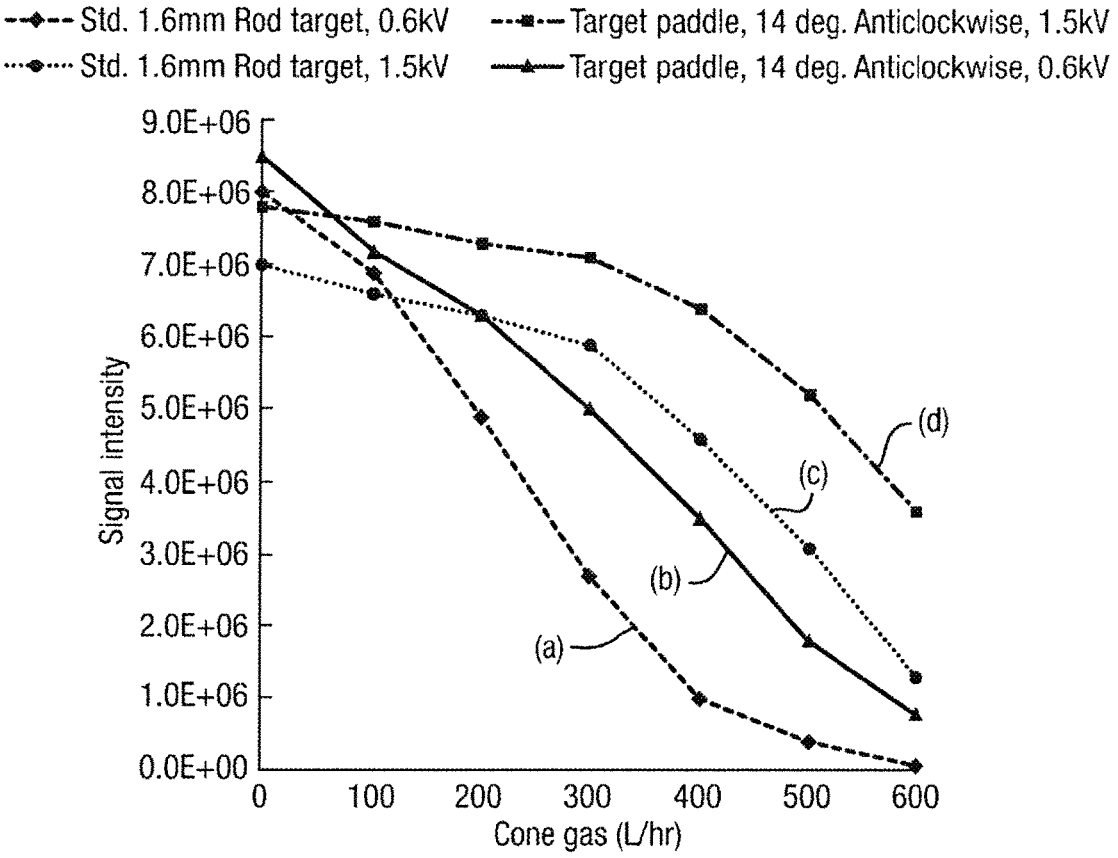
FIG. 3 shows a graph comparing the signal intensity of a conventional impactor spray ion source with a modified impactor spray ion source according to a preferred embodiment of the present invention as a function of cone gas flow rate and which illustrates the improved signal intensity which is obtained at high cone gas flow rates according to the preferred embodiment.

FIG. 3 shows some experimental results demonstrating the improved performance of the modified impactor spray source according to a preferred embodiment of the present invention at relatively high cone gas flow rates.

A 0.2 pg/μL solution of verapamil was infused into the liquid capillary 2 at a flow rate of 0.6 mL/min. The solvent was composed of 1:1 acetonitrile and water with a total formic acid content of 0.1%. The ion signal intensity was then measured at different cone gas flow rates.

Line (a) of FIG. 3 shows the decrease in verapamil signal which was observed when operating a conventional impactor spray ion source as shown in FIG. 1 wherein the target 5 was maintained at 0.6 kV and wherein no additional paddle electrode was provided. The cone gas flow rate was progressively increased from 0 to 600 L/hr. At a cone gas flow rate of 600 L/hr it is apparent that the signal has fallen by two orders of magnitude compared to that obtained with no cone gas flow.

Line (c) of FIG. 3 shows a repeat experiment using the same conventional arrangement but wherein the target voltage was increased to 1.5 kV after optimising the 0 L/hr signal by slightly adjusting the off-axis position of the probe relative to the target. Under these conditions the starting signal falls by a factor of 5.3 when the cone gas flow rate is increased to 600 L/hr.

Curves (b) and (d) of FIG. 3 illustrate the significant improvements in signal intensity at high cone gas flow rates which were achieved using an impactor spray ion source which was modified according to the preferred embodiment.

The experiments described above were repeated at the same target potentials but in accordance with the preferred embodiment wherein a paddle electrode 10 or plate was provided in a manner as shown in FIGS. 2A and 2B.

As can be seen from FIG. 3, at target voltages of 0.6 kV and 1.5 kV the effect of the paddle electrode 10 or plate resulted in signal improvements of ×10.0 and ×2.8 respectively at the highest cone gas flow rate of 600 L/hr.

Further embodiments are contemplated wherein the electric field in the vicinity of the ion inlet region may be further modified and/or optimised by the use of one or more additional electrodes.

Figure 4:
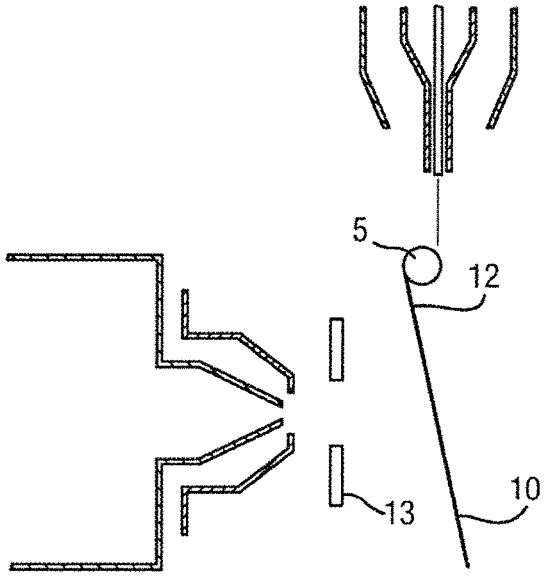
FIG. 4 shows an embodiment of the present invention showing an additional lens electrode which is provided and which is associated with the ion inlet of a mass spectrometer.

FIG. 4 shows an embodiment of the present invention wherein an additional lens element 13 is provided. The lens element 13 may comprise a ring or orifice plate. The lens element 13 is preferably electrically biased with respect to the paddle electrode 10 or plate and/or the cone gas nozzle 6 or other ion inlet device.

Further embodiments are contemplated wherein a plurality of electrodes may be utilised instead of a single electrode 13. The electrodes may each have a characteristic geometry and/or potential bias.

It is known to surround an atmospheric pressure ionisation ("API") ion source with a gas-tight enclosure which comprises an exhaust outlet for the appropriate venting of gases and vapours that may otherwise present a health risk to the operators of the mass spectrometer. However, disadvantageously the size, geometry and material composition of the enclosure can have an effect upon ion beam stability, chemical contamination effects and chromatographic peak broadening.

Figure 5:
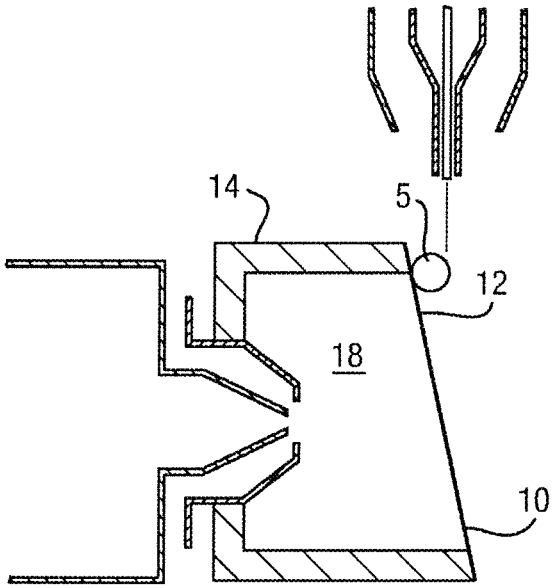
FIG. 5 shows an embodiment of the present invention wherein the additional electrode attached to the target of the impactor spray ion source forms together with an insulating tube an insulating chamber around the ion inlet of a mass spectrometer.

FIG. 5 illustrates an embodiment of the present invention wherein a paddle electrode 10 or plate is provided which is preferably sealed against an insulating tube 14 which is in turn preferably sealed against the cone gas nozzle or other ion inlet device thereby preferably creating a small sampling volume 18. At least a portion of insulating tube 14 may be insulating to isolate the potential of the cone gas nozzle or ion inlet device from the potential of the target 5 and/or electrode 10.

The net flow of gas is preferably determined by the flow entering the paddle aperture 12, the cone gas flow and the flow of gas entering the vacuum system through the ion inlet orifice 8.

According to an embodiment an additional gas exit may be incorporated into the insulating tube 14 if the cone gas flow and the flow through the one or more apertures 12 exceeds the pumping through the ion inlet orifice 8.

The embodiment shown and described above with reference to FIG. 5 provides an atmospheric pressure ionisation source which advantageously results in reduced contamination effects and/or reduced interference effects compared with known ion source enclosures.

A particularly preferred feature of the embodiment shown and described above with reference to FIG. 5 is that the design enables a significant reduction in the size of the main enclosure to be provided thereby enabling a more compact and inexpensive instrument to be provided.

According to a further embodiment one or more additional electrodes 13 as shown and described above in relation to the embodiment shown in FIG. 4 may also be incorporated into the ion source according to the embodiment shown and described with reference to FIG. 5.

Figure 6:
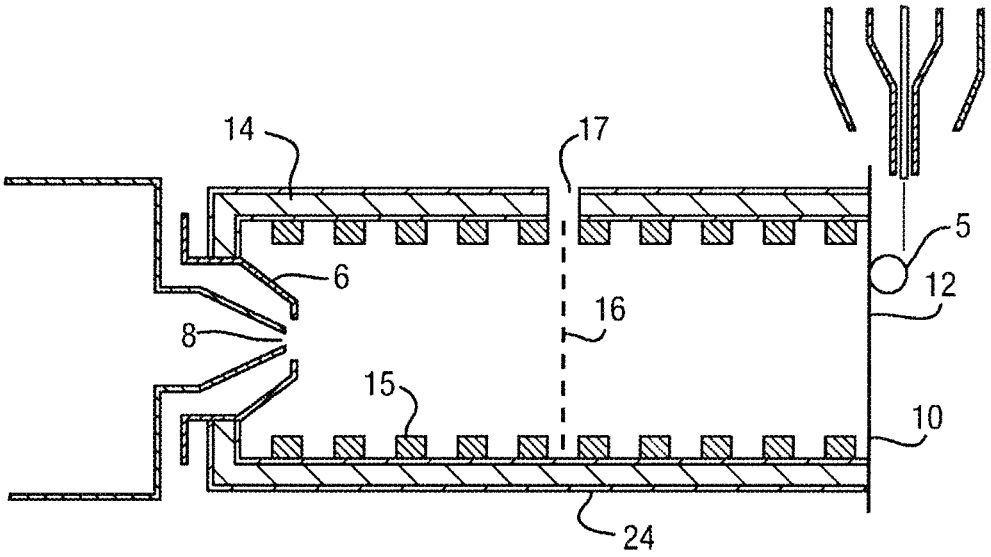
FIG. 6 shows another embodiment of the present invention wherein the additional electrode attached to the target of the impactor spray ion source forms together with an insulating tube an interface between the impactor spray ion source and the ion inlet of a mass spectrometer and wherein at least a portion of the interface includes an ion mobility device.

FIG. 6 shows a further embodiment of the present invention wherein an impactor target 5 and a paddle electrode 10 or plate incorporating an aperture 12 are provided and wherein the paddle electrode 10 or plate preferably form part of an interface between the impactor spray atmospheric pressure ionisation ion source and an ion inlet device of the mass spectrometer. According to a particularly preferred embodiment an ion mobility device such as an ion mobility spectrometer or separator ("IMS") may be incorporated into the interface.

A substantially uniform electric field may preferably be established along the length of the interface and/or ion mobility device by providing an atmospheric pressure drift tube 24 as shown in FIG. 6. The drift tube 24 preferably comprises a series of equally spaced electrode rings 15 which are preferably attached to the drift tube 24. The drift tube 24 preferably comprises an insulating tube 14. The electrode rings 15 may according to an embodiment be biased or otherwise maintained in use at potentials or voltages so as to provide a drift field that preferably moves, directs or urges ions towards the ion inlet orifice 8 of the mass spectrometer. Ions entering the mass spectrometer are then preferably analysed by the mass spectrometer.

According to an embodiment the ion mobility drift tube shown in FIG. 6 may be arranged so as to form a counter-current ion mobility drift tube wherein one flow of gas enters the drift tube 24 via the cone gas nozzle 6 and another flow of gas enters the drift tube 24 via one or more apertures 12 in the paddle electrode 10 or plate which is preferably attached or located in close proximity to the target 5.

According to an embodiment the two separate gas flows may be identical in magnitude and the two gas flows may be arranged to exit the drift tube 24 via a drift tube outlet 17. The drift tube outlet 17 may comprise a plurality of holes or one or more apertures positioned radially around the centre of the insulator tube 14 so as to improve the uniformity of the gas flow.

According to an embodiment an ion gating device 16, such as a Bradbury-Nielsen (B-N) grid, may be provided or otherwise located within the drift tube 24. The ion gating device 16 is preferably arranged to admit a pulse of ions into a drift field region which is preferably formed between the ion gating device or grid electrode 16 and the ion inlet orifice 8 or the ion inlet device. As a result, different analytes, background and solvent ions are preferably subjected to ion mobility separation as they pass from the ion gating device 16 towards the ion inlet orifice 8 or ion inlet device of the mass spectrometer.

One or more additional gas inlets may be incorporated into the paddle electrode 10 or plate in order to balance the gas flows in the drift tube 24 and/or to allow dopant or reactant agents to be introduced.

The ion mobility device as shown in FIG. 6 may take one of a number of different forms with the common feature of an impactor spray inlet.

According to an embodiment the target 5 may comprise or be formed from an insulator (or having an insulating sheath or coating provided thereon) and the paddle electrode 10 or plate may be attached or provided adjacent to target 5. The paddle electrode 10 or plate may comprise a conductor or a semiconductor and the paddle electrode 10 or plate may be maintained at a voltage or otherwise be biased at a potential relative to the target 5.

According to an embodiment the direction of the electric field between the target 5 and/or paddle electrode 10 or plate and the ion inlet device of the mass spectrometer may be reversed such that the electric field is arranged to oppose the flow of ions. According to this embodiment ions having different charge states may then be differentiated and/or specific regions of background ions or background ions having specific charge states may be differentiated. This embodiment is applicable to both discrete electrode systems and also ion mobility mass spectrometry embodiments as described above with reference to FIGS. 2A, 2B and 4-6.

According to other embodiments the target 5 and/or paddle electrode 10 or plate may be utilised with a mass spectrometer inlet system wherein the cone gas nozzle 6 is raised to a relatively high potential (e.g. ≤2 kV) with respect to the ion inlet orifice 8.

Although the present invention has been described with reference to preferred embodiments, it will be understood by those skilled in the art that various changes in form and detail may be made without departing from the scope of the invention as set forth in the accompanying claims.

The invention claimed is:

1. An ion source comprising:

one or more nebulisers and one or more targets, wherein said one or more nebulisers are arranged and adapted to emit, in use, a stream predominantly of droplets which are caused to impact upon said one or more targets and to ionise said droplets to form a plurality of ions; and wherein said ion source further comprises:

one or more electrodes arranged adjacent to and/or attached to said one or more targets wherein said one or more electrodes comprise one or more apertures, notches or cut-outs wherein at least some of said plurality of ions pass, in use, through said one or more apertures, notches or cut-outs.

2. An ion source as claimed in claim 1, wherein said stream predominantly of droplets are caused to impact upon said one or more targets so as to ionise said droplets to form said plurality of ions.

3. An ion source as claimed in claim 1, wherein said one or more targets are shaped or have an aerodynamic profile so that gas flowing past said one or more targets is directed or deflected towards and/or through said one or more apertures, notches or cut-outs.

4. An ion source as claimed in claim 1, wherein said one or more targets are arranged or otherwise positioned so as to deflect said stream of droplets and/or said plurality of ions towards and/or through said one or more apertures, notches or cut-outs.

5. An ion source as claimed in claim 1, wherein said one or more apertures, notches or cut-outs are located at or are otherwise arranged in the vicinity of or immediately downstream of the impact point of said droplet stream upon said one or more targets.

6. An ion source as claimed in claim 1, wherein said one or more electrodes are attached to and/or contact said one or more targets.

7. An ion source as claimed in claim 1, wherein said one or more electrodes are positioned in a plane which is substantially perpendicular to a primary or predominant direction of gas flow through said one or more apertures, notches or cut-outs.

8. An ion source as claimed in claim 1, wherein said one or more electrodes are arranged to have substantially smooth or deburred edges.

9. An ion source as claimed in claim 1, wherein said ion source comprises an Atmospheric Pressure Ionisation ("API") ion source.

10. A mass spectrometer comprising an ion source as claimed in claim 1.

11. A mass spectrometer as claimed in claim 10, further comprising an ion inlet device which leads to a first vacuum stage of said mass spectrometer.

12. A mass spectrometer as claimed in claim 11, wherein in a mode of operation said ion inlet device and/or said one or more targets and/or said one or more electrodes are maintained at different potentials.

13. A mass spectrometer as claimed in claim 12, wherein in a mode of operation said ion inlet device and/or said one or more targets and/or said one or more electrodes are maintained at different potentials such that an electric field is created therebetween that substantially assists or opposes the flow of ions.

14. A mass spectrometer as claimed in claim 11, further comprising an insulating tube or housing which is attached to or arranged adjacent to said ion inlet device and wherein said one or more electrodes are attached to or arranged adjacent to said insulating tube or housing.

15. A mass spectrometer as claimed in claim 14, further comprising an ion mobility spectrometer or separator attached to or arranged adjacent to said ion inlet device and/or arranged within said insulating tube or housing.

16. A mass spectrometer as claimed in claim 15, wherein said ion mobility spectrometer or separator comprises a plurality of further electrodes having apertures through which ions are transmitted in use.

17. A mass spectrometer as claimed in claim 15, wherein said one or more electrodes are attached to or arranged adjacent to said ion mobility spectrometer or separator.

18. A mass spectrometer as claimed in claim 15, wherein said ion mobility spectrometer or separator further comprises one or more ion gating or ion injection devices.

19. A mass spectrometer as claimed in claim 18, wherein said one or more ion gating or ion injection devices is arranged and adapted to pulse ions into an ion mobility drift region arranged between said one more ion gating or injection devices and said ion inlet device, whereupon said ions are separated temporally according to their ion mobility as the ions are urged towards said ion inlet device.

20. An ion mobility spectrometer or separator comprising an ion source as claimed in claim 1.

21. A method of ionising a sample comprising:

providing one or more nebulisers and one or more targets;

causing said one or more nebulisers to emit a stream predominantly of droplets which are caused to impact upon said one or more targets and to ionise said droplets to form a plurality of ions;

positioning one or more electrodes adjacent to and/or attached to said one or more targets wherein said one or more electrodes comprise one or more apertures, notches or cut-outs; and causing at least some of said plurality of ions to pass through said one or more apertures, notches or cut-outs.

22. A method of mass spectrometry comprising a method of ionising a sample as claimed in claim 21.

* * * * *